United States Patent [19]

Wallace

[11] 4,330,024

[45] May 18, 1982

[54] METHOD FOR IN-MOLD DEOXIDATION OF STEEL

[75] Inventor: John F. Wallace, Shaker Heights, Ohio

[73] Assignee: Steel Founder's Society of America, Rocky River, Ohio

[21] Appl. No.: 181,753

[22] Filed: Aug. 27, 1980

[51] Int. Cl.[3] ..... B22D 27/00

[52] U.S. Cl. ..... 164/56.1; 164/57.1

[58] Field of Search ..... 164/55–58; 75/130 R

[56] References Cited

U.S. PATENT DOCUMENTS

| | | | |
|---|---|---|---|
| 3,819,365 | 6/1974 | McCaulay et al. | 164/55 X |
| 3,881,937 | 5/1975 | Teufel | 75/130 R |
| 4,004,630 | 1/1977 | Dunks | 164/55 X |
| 4,210,195 | 7/1980 | McPherson | 164/55 X |

FOREIGN PATENT DOCUMENTS

| | | | |
|---|---|---|---|
| 49-125230 | 11/1974 | Japan | 164/55 |
| 52-24935 | 2/1977 | Japan | 164/56 |
| 55-1928 | 1/1980 | Japan | 164/58 |

*Primary Examiner*—Robert L. Spruill
*Assistant Examiner*—K. Y. Lin
*Attorney, Agent, or Firm*—Fay & Sharpe

[57] ABSTRACT

The specification describes a method and apparatus for deoxidizing steel. Molten steel is tapped into a ladle in which a preliminary deoxidizer of ferrosilicon or the like is added. From the ladle, the molten steel is poured into a runner which is interconnected with a plurality of molds and a deoxidizer chamber. The molten steel flows toward the molds through the deoxidizer chamber dissolving a final deoxidizer. The final deoxidizer is aluminum or a mixture of aluminum with silicon, calcium, magnesium, or their alloys. The molten steel with the dissolved deoxidizer flows into the molds. The deoxidizer chamber is configured and the final deoxidizer is formulated in such a manner that the final deoxidizer is dissolved at a substantially constant rate by the flowing molten steel.

1 Claim, 3 Drawing Figures

METHOD FOR IN-MOLD DEOXIDATION OF STEEL

BACKGROUND OF THE INVENTION

This application pertains to the art of steel processing. It is particularly applicable to a method and apparatus for stabilizing the oxygen content of molten steel during a casting operation. The invention is described in terms of an in the mold deoxidizing method and apparatus, although it will be appreciated that the invention has broader applications.

Heretofore, deoxidation of steel was commonly carried out in the ladle or furnace. More specifically, the steel, commonly including a deoxidizer, was brought to a molten state in the furnace and transferred to a ladle where additional deoxidizers were added. After a hold time in the ladle, the molten steel was poured from the ladle into the sprue well and through an associated runner to the molds. A common problem has been fading. That is, the amount of unreacted deoxidizer in the ladle decreases with time. Thus, the amount of unreacted deoxidizer in the ladle decreases as the molten steel is held awaiting the commencement of casting. Further, it is common to cast several molds from the runner sequentially. Additional fading tends to occur during the interval between casting the first and last mold in the sequence. This tends to cause a variation in the properties of the steel in each of the plurality of castings. To assure that an adequate amount of deoxidizer is still present in the molten steel when the last casting is made, more deoxidizer is commonly added to the ladle than is necessary for the first one or first several castings. A common deoxidizer is aluminum. It has been found, however, that when an excessive amount of aluminum is added, generally above about 0.08%, aluminum nitride embrittlement of the resultant castings tends to occur.

A runner which has some similarities to the present invention has been used in the Dunks method for changing the morphology of flake graphite in gray iron to speroidal graphite to form ductile iron. In the Dunks procedure, which is described in U.S. Pat. No. 4,004,630, issued Jan. 25, 1977 to C. M. Dunks, a nucleation agent commonly containing magnesium is added to a chamber in the runner to be dissolved into the cast iron as it moves through the runner toward the molds. The Dunks procedure, however, has a different intended purpose—the nucleation of graphite, not the reduction of oxygen. The physical parameters in iron casting are different from those in steel casting. The concentration of the nucleation agent is much higher than the concentration of deoxidizer. For example, commonly a magnesium nucleation agent is added to the cast iron which produces an alloy which contains 0.15 to 0.75% magnesium. In deoxidizing steel, aluminum deoxidizer is added in sufficiently small quantities to produce a cast steel alloy which is less than 0.08% aluminum. Magnesium is a reactive additive which boils below the temperature of the molten iron. The boiling causes a violent reaction with the iron causing agitation and infusion into the metal. Aluminum is an unreactive additive which melts but does the boil at the temperature of the molten steel. Agitation is required to dissolve and mix the aluminum through the steel. The temperatures involved in steel casting are higher than the temperatures involved in cast iron casting. Further, the addition of the deoxidizer as the molten steel moves through the runner would be expected to cause castings of poor quality. One would expect deoxidation products to impregnate the steel casting with damaging oxide inclusions.

The present invention contemplates a new and improved method and apparatus for casting steel which overcomes all of the above referenced problems and others. It provides a method and apparatus for casting steel which closely controls the amount of deoxidizer in the steel but which is readily used in conjunction with existing casting apparatus and methods.

SUMMARY OF THE INVENTION

In accordance with the present invention, there is provided a method for deoxidizing and casting steel which comprises the steps of introducing a deoxidizer which contains aluminum into a runner having a chamber which depends therebeneath, pouring molten steel into the runner such that the molten steel flows through the chamber dissolving the deoxidizer, and casting the molten steel with the dissolved deoxidizer from the runner into molds.

In accordance with another aspect of the invention, there is provided an apparatus for in the mold deoxidation of steel. The apparatus includes a sprue well for receiving molten steel from a ladle or the like. Connected with the sprue well is a channel for conveying the molten steel from the sprue well to at least one mold. Disposed in fluid connection with the channel is a chamber for receiving a deoxidizer. The chamber is disposed relative to the channel in such a manner that molten steel flows through the chamber as it is conveyed from the sprue well to the mold.

A principle advantage of the invention is that it constrains the amount of deoxidizer in molten steel within a narrow, predetermined acceptable range during the casting of several sequentially filled molds.

Another advantage of the present invention is that it holds the aluminum concentration in molten steel sufficiently high that it is effective as a deoxidizer and sufficiently low that aluminum nitride embrittlement does not occur.

Other advantages will become readily apparent to those reading and understanding the following specification.

BRIEF DESCRIPTION OF THE FIGURES

The invention may take physical form in certain parts and arrangement of parts. A preferred embodiment of which is described in detail in the specification, below, and illustrated in the accompanying drawings which form a part thereof. The drawings serve only to illustrate a preferred embodiment of the invention and are not to be construed as limiting it.

DESCRIPTION OF THE PREFERRED EMBODIMENT

Figure 1:
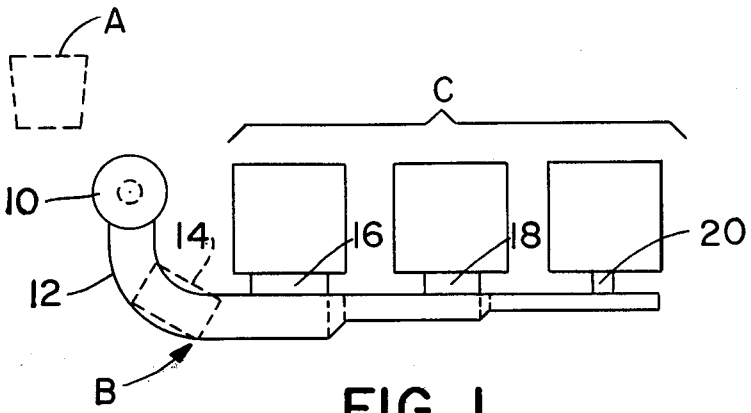
FIG. 1 is a top plan view of a casting apparatus in accordance with the present invention.

With reference now to FIG. 1, there is shown a ladle A which holds molten steel. In performing a casting operation, the molten steel is poured from the ladle A into a runner B which conveys the molten steel to a plurality of molds C. The runner B includes a sprue well 10 which receives the molten steel from the ladle. The molten steel is conveyed from the sprue well through a channel 12. Disposed in fluid connection with the channel is a deoxidizer chamber 14 for holding a deoxidizer. The deoxidizer chamber is arranged such that the molten steel flows through the deoxidizer chamber and dissolves the deoxidizer. Ingates 16, 18, and 20 are arranged each adjacent one of the molds at progressively higher elevations to cause the molds to be filled sequentially by the molten steel with dissolved deoxidizer.

More specifically, a charge material is heated in a furnace to form the molten steel. The molten steel is tapped into a ladle. A preliminary deoxidation is performed by adding silicon, silicon and manganese, or other suitable deoxidizers to the melt. From the ladle, the molten steel is poured into the runner B and flows through the deoxidizer chamber 14 to the molds. In the deoxidizer chamber, the molten steel dissolves the deoxidizer to perform a final deoxidation of the steel. The final deoxidizer dissolves at a substantially constant rate or at a rate which increases commensurate with the fading rate of the preliminary oxidizer. The deoxidizer used in the final deoxidation is an element, combination of elements, alloy, or the like which has a strong affinity for oxygen, e.g. aluminum, calcium, magnesium, rare earth elements, titanium, or zirconium.

Looking to the preferred method in more detail, the charge which is melted in the furnace is a conventional steel composition, such as iron containing 0.30% carbon, 0.40% silicon, 0.70% maganese, 0.025% sulfur, and 0.008% phosphorous. The melt is superheated to about 3000° F. before being tapped into the ladle. Preliminary deoxidizers are added to the melt in the ladle. The preferred preliminary deoxidizer is silicon or another non-aluminum oxidixer. As noted above, the effectiveness of the deoxidizer tends to face with time. To counteract the fading, the present method contemplates adding a final oxidizer to the melt while the molten steel is moving through the runner. The final deoxidizer is added to the deoxidizer chamber and heated to about 250° F. When the molds are properly prepared and casting is to begin, the molten steel is poured from the ladle into the sprue well for the runner to convey the molten steel to the molds. Commonly, the pouring temperature of the steel is in the range of about 2840° to about 2950° F.

The final deoxidizer is selected from the class of deoxidizers consisting essentially of aluminum and mixtures of aluminum and ferrosilicon, magnesium, calcium, and their alloys. Aluminum has a high affinity for oxygen, high solubility in steel, low cost, ready availability, and ease of addition to molten metals. When cast, it is desirable for the resultant steel composition to have at least 0.01% but less than 0.08% aluminum. Aluminum is an unreactive deoxidizer, that is it dissolves quietly into the molten metal. Other deoxidizers may be used instead of or in addition to the aluminum. Other suitable deoxidants include CaMgSi, MgCaSi, MgAl, and other alloys of calcium, magnesium, and aluminum, FeSi, and the like. The molten steel has a temperature which is above the boiling point of calcium and magnesium and other reactive deoxidizers. Upon contacting the molten steel, they react with sufficient violence to cause a turbulence which mixes the steel and the deoxidizer. The aluminum and ferrosilicon, on the other hand, are unreactive oxidizers which melt quietly when contacted by the molten steel. Physical stirring or agitation is needed to mix the unreactive oxidizers with the steel. Reactive oxidizers can be mixed with unreactive oxidizers to improve mixing into the steel.

In the preferred embodiment, the final deoxidizer is a mixture of aluminum and ferrosilicon. Excellent results have been obtained when a 6.5% aluminum-iron alloy mixed with ferrosilicon in a volumetric ratio of between 2:1 and 2:3. Alternately, a small amount of calcium or magnesium containing compounds may be added to increase the turbulence and mixing of the deoxidizer with the molten steel. The ferrosilicon, in addition to functioning as a deoxidizer, tends to slow the dissolution rate of the aluminum to help cause a more uniform dissolving of aluminum in the steel. The deoxidizer is formulated to dissolve at a generally uniform rate over the duration of the casting. The dissolution time and rate are determined by the physical configuration of the deoxidizer chamber, the composition of the deoxidizer, and the like. To extend the dissolution time and decrease the dissolution rate, more aluminum-iron alloy or mixture with a smaller percentage of aluminum, may be used. To decrease the dissolution time and increase the rate, less of a higher aluminum concentration alloy or mixture may be used or a reactive deoxidizer may be added.

The aluminum may be added in various forms. It has been found that four mesh pellets provide satisfactory results. However, aluminum in other physical forms such as powders, wires, larger pellets, smaller pellets, and the like also achieve satisfactory results.

Alternately, aluminum may be used in both the preliminary and final deoxidations. The total amount of aluminum in both deoxidations should be selected to result a concentration in the cast steel of 0.01 to 0.08%. In another alternative, all the aluminum may be added in the preliminary oxidation and other oxidizers used in the final oxidation.

Figure 2:
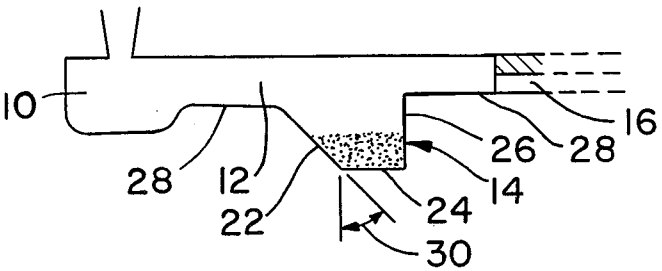
FIG. 2 is a diagrammatic side view of a part of a runner found in apparatus constructed in accordance with the present invention.

The dissolution rate is also affected by the structure of deoxidizer chamber 14. More surface area and structures to increase turbulence tend to increase the dissolution rate. With reference to FIG. 2 which illustrates the preferred embodiment, the deoxidizing chamber includes a back wall 22 which is disposed towards the sprue well 10, a bottom wall 24, a front wall 26 which is disposed towards the molds, and side walls to close the chamber on five sides. The back, bottom, front, and side walls are connected at their top edges with the floor or bottom 28 of the channel 12. The back wall 22 is disposed at an angle 30 to the vertical. In the preferred embodiment angle 30 is substantially 30°. It has been found, however, that angles of 30° to 40° produce excellent results and that angles generally in the range of 20° to 45° produce, in many circumstances, satisfactory results.

To dissolve the deoxidizer at the preselected, constant rate, the deoxidizing chamber is constructed with the appropriate surface area and to cause a turbulence in the flow of molten steel. The exact size of the chamber is selected as a function of the casting rate, temperature of the steel, the slope of the runner, the volume of steel being cast, the selected deoxidizer and the like. There is a tendency for the molten steel to solidify into a shell when it first meets the cooler deoxidizer. Turbulence in the chamber induces a sufficient amount of molten steel to flow across the shell to dissolve it. The turbulence continues to mix the aluminum into molten steel as the molten steel flows through the chamber. If the turbulence is too small, the shell is dissolved very slowly and the aluminum is not released until late in the casting process. If the turbulence is too great, the aluminum is dissolved rapidly causing most of the aluminum to be dissolved before all of the molten steel has flowed through the chamber. Several factors influence the turbulence in the deoxidizer chamber 22. These factors include the physical dimensions and configuration of the chamber, the angle 30, and the nature of the deoxidizer.

By way of example, a sample run of low carbon steel was melted and poured at a temperature generally in the range of 2840° to 2950° F. into a runner of the above described construction. A deoxidant of 0.065 weight percent aluminum as four mesh pellets was mixed with ferrosilicon in a 2:1 volume ratio. The angle 30 of the deoxidizer chamber rear wall was selected at 30°. This combination of physical factors produced three castings sequentially which are summarized as follows:

| Casting Sequence | Percent of Aluminum In Casting |
|---|---|
| First | .02 |
| Second | .02 |
| Third | .03 |

Analogous results may be obtained with other combinations of the above deoxidizers and other physical configurations of the deoxidizing chamber.

Figure 3:
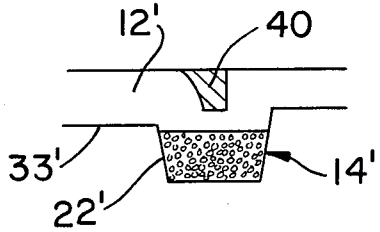
FIG. 3 is a diagrammatic side view of an alternate deoxidizer chamber construction in accordance with the present invention.

FIG. 3 shows an alternate embodiment of a section of the runner B of FIG. 1 in accordance with the present invention. In the embodiment of FIG. 3, like elements are marked with the same reference numeral as in FIGS. 1 and 2 but followed by a prime (′). In this embodiment, a core baffle 40 is disposed in the channel 12′ of the runner. The core baffle 40 deflects the flowing molten steel into the deoxidizer chamber 14′ and causes turbulence. The rear wall 22′ may be generally vertical.

The invention has been described with reference to the preferred method and apparatus. Obviously, modifications and alterations will occur to other upon reading and understanding this specification. It is my intention to include all such modifications and alterations insofar as they come within the scope of the appended claims of the equivalents thereof.

I claim:

1. A method of uniformly deoxidizing molten steel which comprises:

subjecting the molten steel to a preliminary deoxidation treatment in the furnace or ladle;

pouring said preliminarily deoxidized steel into a runner having a chamber depending therebeneath, with said chamber containing an aluminum deoxidizer consisting of 6.5% aluminum-iron pellets and ferrosilicon, with the ratio of said aluminum-iron pellets to said ferrosilicon being between 2:1 and 2:3 by volume and being constructed such that metal turbulence is created in said chamber whereby the available oxygen impurity in said molten metal is caused to uniformly and non-violently react with said aluminum deoxidizer; and casting the uniformly deoxidized molten metal into molds.

* * * * *